US011817659B2

(12) United States Patent
Churnovic et al.

(10) Patent No.: US 11,817,659 B2
(45) Date of Patent: Nov. 14, 2023

(54) RJ45 SHUTTERED JACKS AND RELATED COMMUNICATION SYSTEMS

(71) Applicant: Panduit Corp., Tinley Park, IL (US)

(72) Inventors: Roman J. Churnovic, Joliet, IL (US); Robert E. Fransen, Orland Park, IL (US)

(73) Assignee: Panduit Corp., Tinley Park, IL (US)

( * ) Notice: Subject to any disclaimer, the term of this patent is extended or adjusted under 35 U.S.C. 154(b) by 612 days.

(21) Appl. No.: 15/780,325

(22) PCT Filed: Dec. 5, 2016

(86) PCT No.: PCT/US2016/064895

§ 371 (c)(1),
(2) Date: May 31, 2018

(87) PCT Pub. No.: WO2017/100114

PCT Pub. Date: Jun. 15, 2017

(65) Prior Publication Data

US 2018/0358764 A1 Dec. 13, 2018

Related U.S. Application Data

(60) Provisional application No. 62/264,405, filed on Dec. 8, 2015.

(51) Int. Cl.

| | |
|---|---|
| ***H01R 13/453*** | (2006.01) |
| ***H01R 24/64*** | (2011.01) |
| ***H01R 13/52*** | (2006.01) |
| ***H01R 13/6582*** | (2011.01) |

(52) U.S. Cl.

CPC ..... *H01R 24/64* (2013.01); *H01R 13/4536* (2013.01); *H01R 13/5213* (2013.01); *H01R 13/6582* (2013.01)

(58) Field of Classification Search

CPC ..... G02B 6/3825; G02B 6/3859; H01R 13/4532–4538; H01R 13/5213; H01R 13/6582; H01R 24/64

See application file for complete search history.

(56) References Cited

U.S. PATENT DOCUMENTS

| | | | |
|---|---|---|---|
| 3,486,159 | A | 12/1969 | Matthews |
| 4,666,225 | A | 5/1987 | Hampton et al. |

(Continued)

FOREIGN PATENT DOCUMENTS

| | | | |
|---|---|---|---|
| CN | 204289830 | U | 4/2015 |
| EP | 0598192 | A1 | 5/1994 |

(Continued)

OTHER PUBLICATIONS

A front photograph of a 3M Volition RJ45 K5e Jack (model # VOL-OCK5E-U) showing a shutter. The shutter is hinged on the bottom; 1 page.

(Continued)

*Primary Examiner* — Felix O Figueroa
(74) *Attorney, Agent, or Firm* — Christopher S. Clancy; James H. Williams; Christopher K. Marlow

(57) ABSTRACT

Certain embodiments of the present invention provide an RJ45 jack that has a self-closing shutter door and allows for RJ45 plug insertion in one linear motion, but which incorporates a free contact plug stop on the shutter door and a door catch feature that aids in the retention of the door in the housing when a plug is subjected to a pull out force while latched into the jack.

3 Claims, 11 Drawing Sheets

(56) References Cited

U.S. PATENT DOCUMENTS 4,712,861 A 12/1987 Ukas et al.
4,713,016 A 12/1987 Kato
4,779,950 A 10/1988 Williams
4,847,711 A 7/1989 Inoue
4,960,317 A 10/1990 Briggs et al.
5,083,945 A 1/1992 Miskin et al.
5,145,409 A 9/1992 Sato et al.
5,163,836 A 11/1992 Young et al.
5,186,647 A 2/1993 Denkmann et al.
5,199,891 A 4/1993 Reed
5,207,597 A 5/1993 Kline et al.
5,228,872 A 7/1993 Liu
5,267,868 A 12/1993 Wolff, Jr.
5,299,956 A 4/1994 Brownell et al.
5,302,141 A 4/1994 O'Reilly et al.
5,363,460 A * 11/1994 Marazzi ..... G02B 6/3825 385/55
5,378,172 A 1/1995 Roberts
5,503,572 A 4/1996 White et al.
5,506,922 A 4/1996 Grois et al.
5,586,914 A 12/1996 Foster, Jr. et al.
5,603,623 A 2/1997 Nishikawa et al.
5,634,802 A 6/1997 Kerklaan
5,697,794 A 12/1997 Mosquera
5,716,224 A 2/1998 Masuda et al.
5,716,237 A 2/1998 Conorich et al.
5,755,595 A 5/1998 Davis et al.
5,766,034 A 6/1998 Block et al.
5,769,647 A 6/1998 Tulley et al.
5,779,503 A 7/1998 Tremblay et al.
5,791,943 A 8/1998 Lo et al.
5,797,764 A 8/1998 Coulombe et al.
5,800,188 A 9/1998 Barber et al.
5,871,364 A 2/1999 Shinchi et al.
5,873,744 A 2/1999 Ramos, Jr.
5,885,111 A 3/1999 Yu
5,908,331 A 6/1999 Hsu et al.
5,915,989 A 6/1999 Andriaenssens et al.
5,938,480 A 8/1999 Aldous et al.
5,956,444 A 9/1999 Duda et al.
5,964,600 A 10/1999 Miles et al.
5,997,358 A 12/1999 Andriaenssens et al.
6,000,968 A 12/1999 Hagiwara
6,004,043 A 12/1999 Abendschein et al.
6,010,343 A 1/2000 Konoya et al.
6,010,358 A 1/2000 Li
6,017,229 A 1/2000 Tulley et al.
6,017,247 A 1/2000 Gwiazdowski
6,057,743 A 5/2000 Aekins
6,079,996 A 6/2000 Arnett
6,086,421 A 7/2000 Wu et al.
6,106,335 A 8/2000 Merchant et al.
6,108,482 A 8/2000 Roth
6,120,330 A 9/2000 Gwiazdowski
6,130,977 A 10/2000 Rosson
6,142,828 A 11/2000 Pepe
6,154,597 A 11/2000 Roth
6,155,881 A 12/2000 Arnett et al.
6,168,474 B1 1/2001 German et al.
6,176,742 B1 1/2001 Arnett et al.
6,196,854 B1 3/2001 Hand
6,196,880 B1 3/2001 Goodrich et al.
6,231,397 B1 5/2001 de la Borbolla et al.
6,238,235 B1 5/2001 Shavit et al.
6,247,849 B1 6/2001 Liu
6,255,593 B1 7/2001 Reede
6,267,617 B1 7/2001 Nozick
6,287,133 B1 9/2001 Yang
6,292,564 B1 9/2001 Cowan et al.
6,299,476 B1 10/2001 Schramme et al.
6,305,950 B1 10/2001 Doorhy
6,319,069 B1 11/2001 Gwiazdowski
6,332,810 B1 12/2001 Bareel
6,338,655 B1 1/2002 Masse et al.
6,354,746 B1 3/2002 Lee
6,356,162 B1 3/2002 DeFlandre et al.
6,371,793 B1 4/2002 Doorhy et al.
6,375,480 B1 4/2002 Chen et al.
6,379,157 B1 4/2002 Curry et al.
6,379,175 B1 4/2002 Reede
6,402,560 B1 6/2002 Lin
6,409,547 B1 6/2002 Reede
6,410,845 B2 6/2002 Reede
6,410,857 B1 6/2002 Gonya
6,425,694 B1 * 7/2002 Szilagyi ..... G02B 6/3849 385/139
6,464,529 B1 10/2002 Jensen et al.
6,464,541 B1 10/2002 Hashim et al.
6,471,412 B1 * 10/2002 Belenkiy ..... G02B 6/3825 385/137
6,520,808 B2 2/2003 Forbes et al.
6,524,139 B1 2/2003 Chang
6,533,618 B1 3/2003 Aekins
6,554,638 B1 4/2003 Hess et al.
6,558,175 B1 5/2003 Yu
6,558,186 B1 5/2003 LePottier et al.
6,595,696 B1 7/2003 Zellak
6,600,865 B2 7/2003 Hwang
6,685,362 B2 * 2/2004 Burkholder ..... G02B 6/3825 385/78
6,688,911 B2 2/2004 Fuerst et al.
6,715,930 B2 * 4/2004 McBride ..... G02B 6/3825 385/73
6,736,681 B2 5/2004 Arnett
6,769,937 B1 8/2004 Roberts
6,780,035 B2 8/2004 Bohbot
6,796,719 B2 * 9/2004 Zhu ..... G02B 6/3849 385/76
6,802,743 B2 10/2004 Aekins et al.
6,869,297 B2 3/2005 Caveney
6,881,096 B2 4/2005 Brown et al.
6,914,324 B2 7/2005 Rapport et al.
6,953,362 B2 10/2005 Mössner et al.
7,150,657 B2 12/2006 Quenneville et al.
7,153,168 B2 12/2006 Caveney et al.
7,179,131 B2 2/2007 Caveney et al.
7,187,766 B2 3/2007 Hammond, Jr.
7,252,554 B2 8/2007 Caveney et al.
7,265,300 B2 9/2007 Adriaenssens et al.
7,281,957 B2 10/2007 Caveney
7,315,224 B2 1/2008 Gurovich et al.
7,364,444 B2 4/2008 Kellock et al.
7,627,043 B2 12/2009 Horowitz et al.
7,717,626 B2 * 5/2010 Cheng ..... G02B 6/3849 385/139
7,744,388 B2 6/2010 Lee
7,785,018 B2 * 8/2010 Jones ..... G02B 6/3849 385/58
7,821,370 B1 * 10/2010 Shu ..... G02B 6/4292 336/107
8,690,459 B2 * 4/2014 Lin ..... G02B 6/3849 385/92
9,196,997 B2 * 11/2015 Sanders ..... G02B 6/3849
9,453,963 B2 * 9/2016 Sato ..... G02B 6/241
9,627,827 B2 * 4/2017 Bragg ..... H01R 24/64
10,205,280 B2 * 2/2019 Lee ..... H01R 13/518
10,608,389 B2 * 3/2020 Correia ..... H01R 24/64
2001/0014563 A1 8/2001 Morita et al.
2004/0033030 A1 * 2/2004 Ohbayashi ..... G02B 6/4292 385/88
2004/0142589 A1 7/2004 Caveney
2012/0184118 A1 7/2012 Ee et al.
2013/0260582 A1 * 10/2013 White ..... H01R 13/5213 439/149
2015/0118874 A1 * 4/2015 Watanabe ..... H01R 13/4536 439/138
2015/0295350 A1 10/2015 Bragg

FOREIGN PATENT DOCUMENTS

EP 0901201 A1 3/1999
EP 1063734 A2 12/2000
EP 1191646 A2 3/2002

(56) References Cited

FOREIGN PATENT DOCUMENTS

| | | | |
|---|---|---|---|
| FR | 2723268 | A1 | 2/1996 |
| FR | 2823606 | A1 | 10/2002 |
| GB | 2380334 | A | 4/2003 |
| JP | S6190176 | U | 6/1986 |
| JP | 3197325 | U | 5/2015 |
| WO | 9930388 | A1 | 6/1999 |
| WO | 9945611 | A1 | 9/1999 |
| WO | 0180376 | A1 | 10/2001 |
| WO | 0182418 | A1 | 11/2001 |
| WO | 2004001906 | A1 | 12/2003 |
| WO | 2004086828 | A1 | 10/2004 |
| WO | 2005101579 | A1 | 10/2005 |

OTHER PUBLICATIONS

A bottom-left photograph of the front of a 3M Volition RJ45 K5e Jack (model # VOL-OCK5E-U) showing a plug inserted into the jack, with the shutter deflected downwardly; 1 page.

3M news bulletin: New 3M Volition Category 5e Cabling Systems Target Distributed Networks, Small Businesses, Homes; 2 pages; May 7, 2002.

3M Volition™ Network Solutions product bulletin: Leading the Way in Network Migration through Innovative Connectivity Solutions; 6 pages; 2002.

3M Volition™ Copper Cabling System product bulletin: Category 5e Structured Cabling System; 11 pages; 2002.

3M Volition ™ Copper Cabling System product bulletin: Category 6 Structured Cabling System; 11 pages; 2002.

* cited by examiner

RJ45 SHUTTERED JACKS AND RELATED COMMUNICATION SYSTEMS

FIELD OF INVENTION

The present invention relates to network communications, and more particularly, RJ45 shuttered jacks and related communication systems.

BACKGROUND

RJ45 is a preferred standard of network communication. Therefore, there is a need for RJ45 jacks and related communication systems.

Shuttered jacks are also desirable, as a shutter door protects internal jack components from external contaminants, such as dust and other debris. However, existing RJ45 shuttered jacks, such as Panduit's MINI-COM® Shuttered Jack Modules, require two motions for RJ45 plug insertion—one to open the shutter door and one to insert the plug. Therefore, there is a need for RJ45 shuttered jacks and related communication systems, and more particularly, RJ45 shuttered jacks and related communication systems that require one motion for RJ45 plug insertion.

Additionally, the International Electrotechnical Commission ("IEC") has established certain standards for RJ45 connectors. For example, IEC 60603-7 requires that RJ45 connectors include free contact plug stops. Additionally, IEC 60603-7 AP2.2 requires that RJ45 connectors withstand 50N (11 lbf) for 60 s±5 s at a maximum load rate of 44.5N/s (10 lbf/s). Therefore, there is a need for RJ45 shuttered jacks and related communication systems that comply with these standards.

SUMMARY

Certain embodiments of the present invention provide an RJ45 jack that has a self-closing shutter door and allows for RJ45 plug insertion in one linear motion, but which incorporates a free contact plug stop on the shutterdoor and a door catch feature that aids in the retention of the door in the housing when a plug is subjected to a pull out force while latched into the jack.

These and other features, aspects, and advantages of the present invention will become better understood with reference to the following drawings, description, and any claims that may follow.

DETAILED DESCRIPTION

Figure 1:
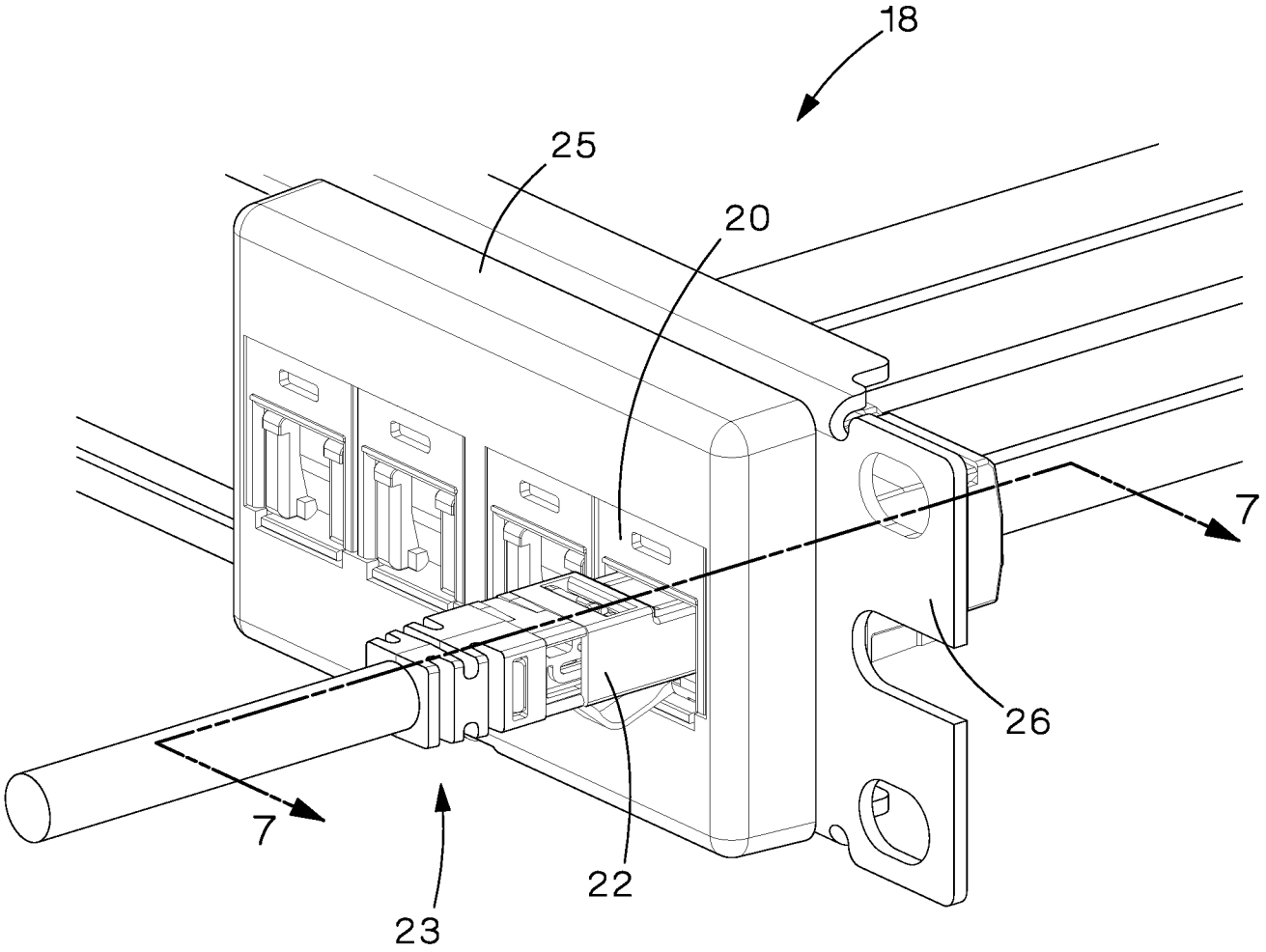
FIG. 1 is a perspective view of a communication system according to an embodiment of the present invention.
Figure 3:
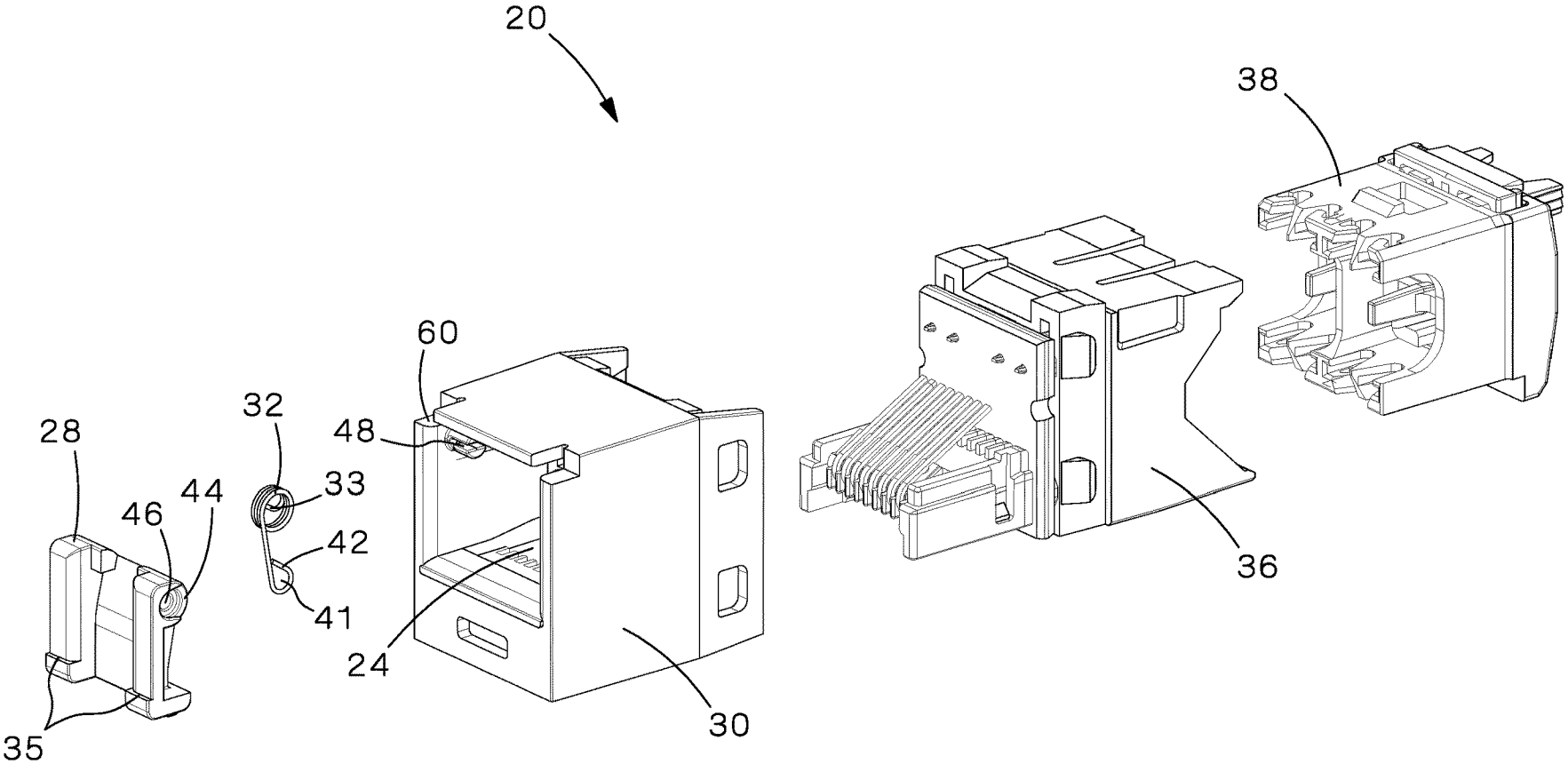
FIG. 3 is an exploded view of the jack of FIG. 2.

Referring to FIG. 1, communication system 18 includes UTP RJ45 shuttered jacks 20 installed in insert 25 of patch panel 26. One UTP RJ45 shuttered jack 20 is in its mated state with plug 22 of patch cord 23 in jack opening 24 (FIG. 3). The other UTP RJ45 shuttered jacks 20 are in a quiescent state.

Figure 2:
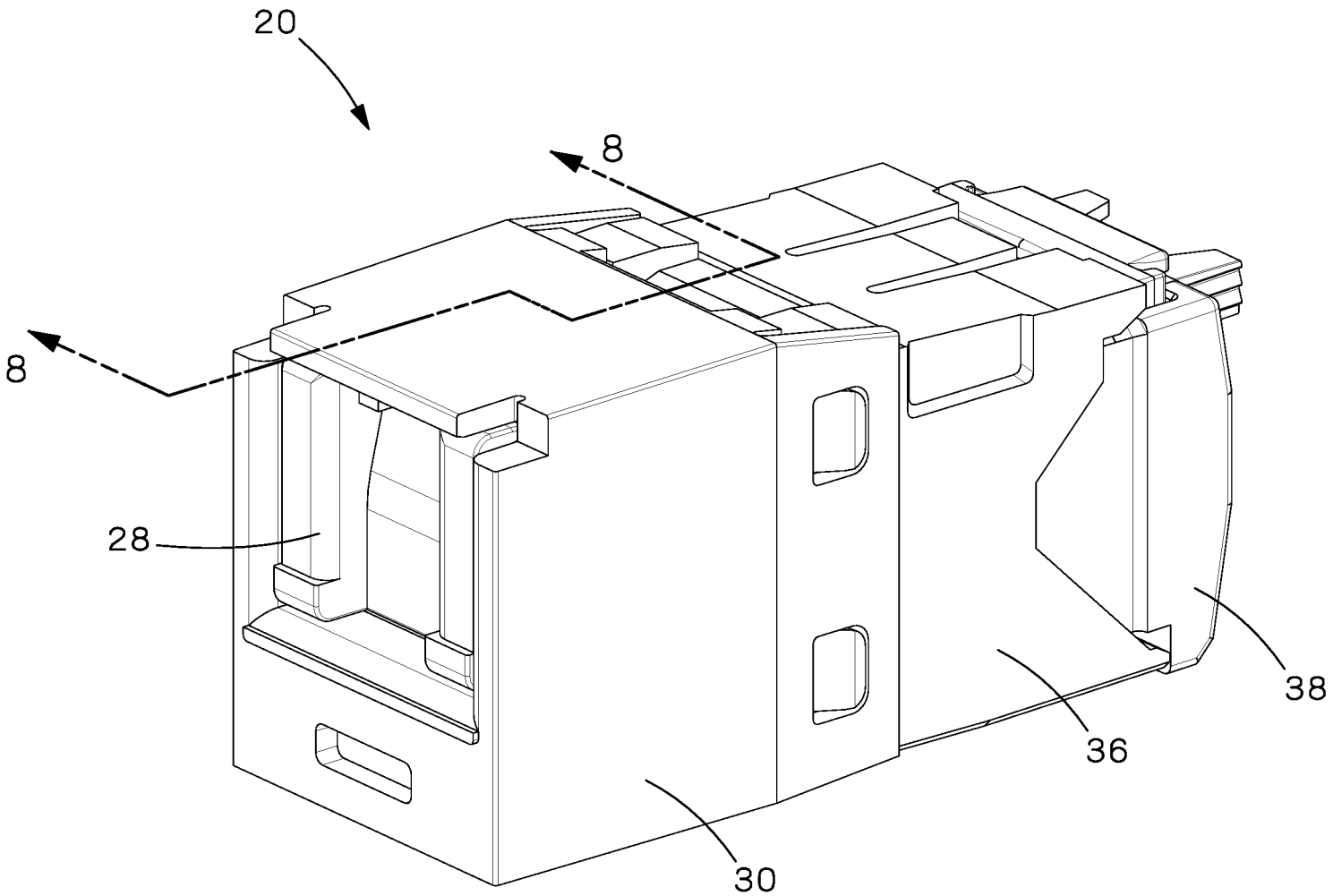
FIG. 2 is a perspective view of a jack according to an embodiment of the present invention.
Figure 4:
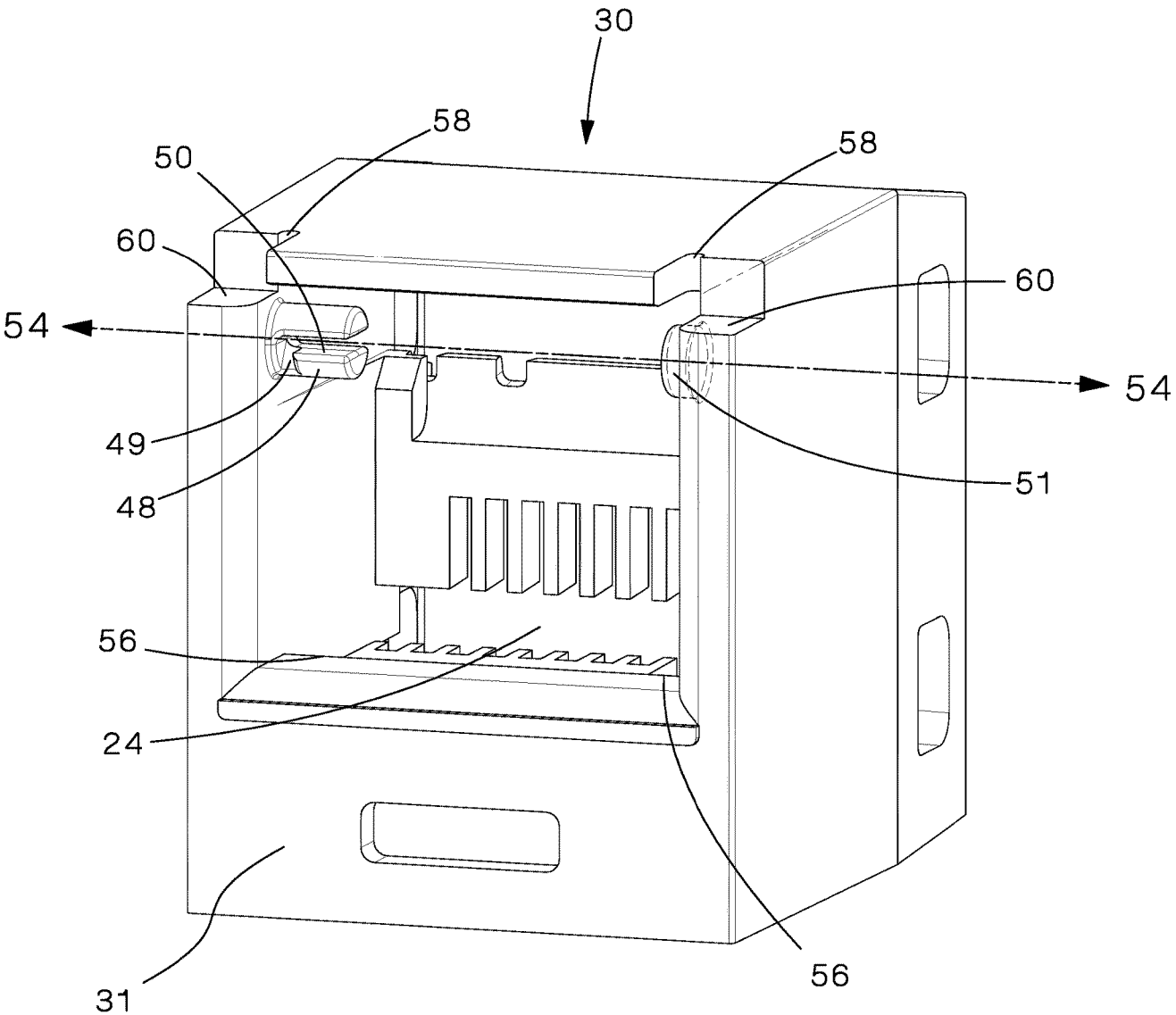
FIG. 4 is a perspective view of a jack housing from the jack of FIG. 2.
Figure 5:
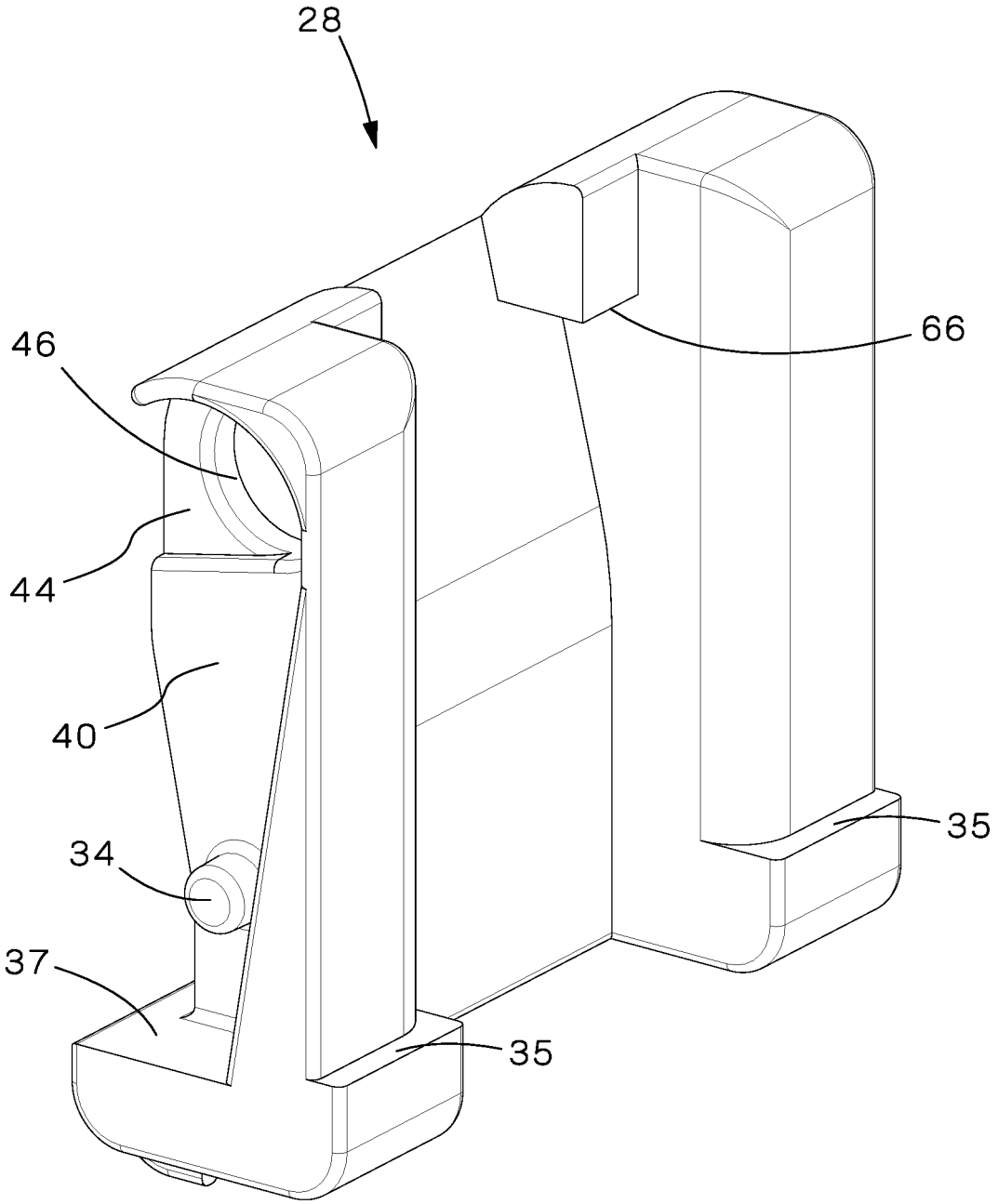
FIG. 5 is a perspective view of a shutter door from the jack of FIG. 2.
Figure 6:
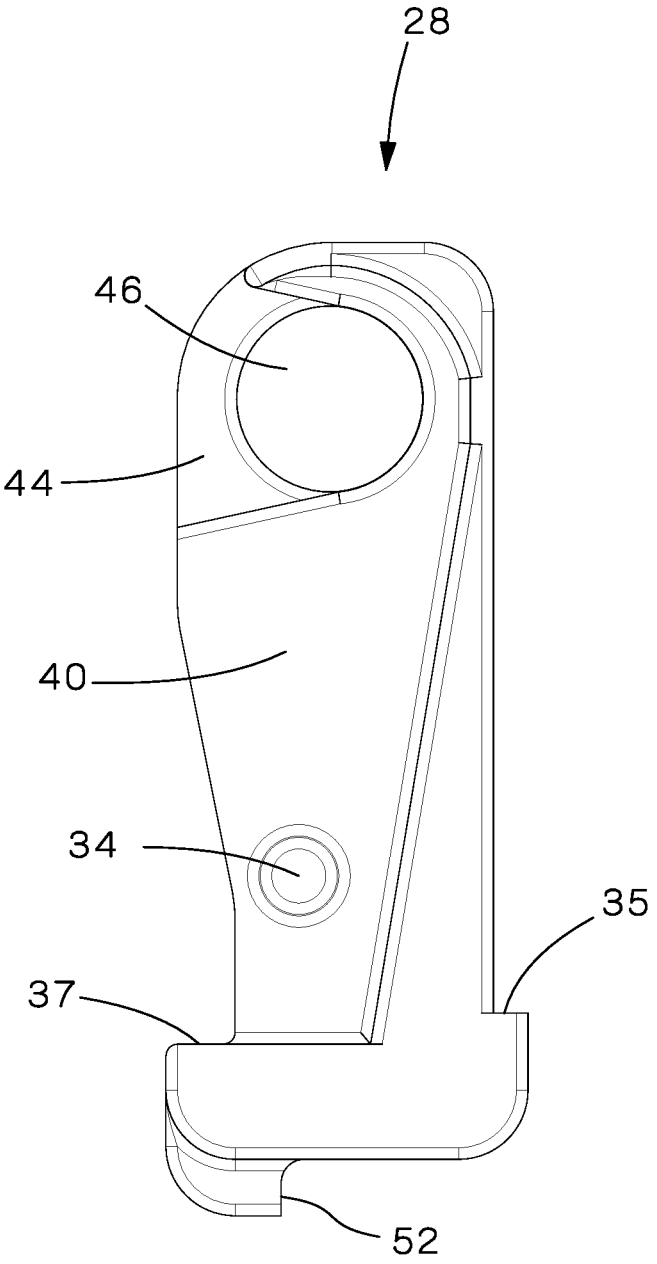
FIG. 6 is a side view of the shutter door of FIG. 2.

Referring to FIGS. 2 and 3, UTP RJ45 shuttered jack 20 includes shutter door 28, spring 32, shuttered jack housing 30, rear sled assembly 36, and wire cap 38. During assembly, diagonal cross leg 33 of spring 32 is inserted into horizontal slot 50 (FIG. 4) of slotted boss 48 on shuttered jack housing 30. Diagonal cross leg 33 then turns and locks into diagonal slot feature 49 of slotted boss 48. Revolute joint pocket 46 (FIG. 5) of shutter door 28 locks onto slotted boss 48 and solid boss 51 of shuttered jack housing 30 after spring 32 has been assembled to shuttered jack housing 30. To ease assembly, loop 41 on the end of spring leg 42 is captured by boss feature 34 on shutter door 28, which helps position spring 32 into pocket 40 on shutter door 28. Recessed plane 44 on shutter door 28 helps ease assembly by allowing slotted boss 48 and solid boss 51 on shuttered jack housing 30 to slide into revolute joint pocket 46 of shutter door 28.

Referring to FIGS. 4-6 and 8, door stops 52 on shutter door 28 prevent shutter door 28 from swinging past the vertical flat plane 31 on shuttered jack housing 30 by contacting inside front edge 56 on shuttered jack housing 30. When installed, shutter door 28 will rotate 90 degrees inward about axis 54, when contacted by plug 22. Relief slots 58 allow deflection of sidewalls 60 when revolute joint pocket 46 of shutter door 8 is assembled onto slatted boss 48 and solid boss 51 of shuttered jack housing 30.

Figure 7:
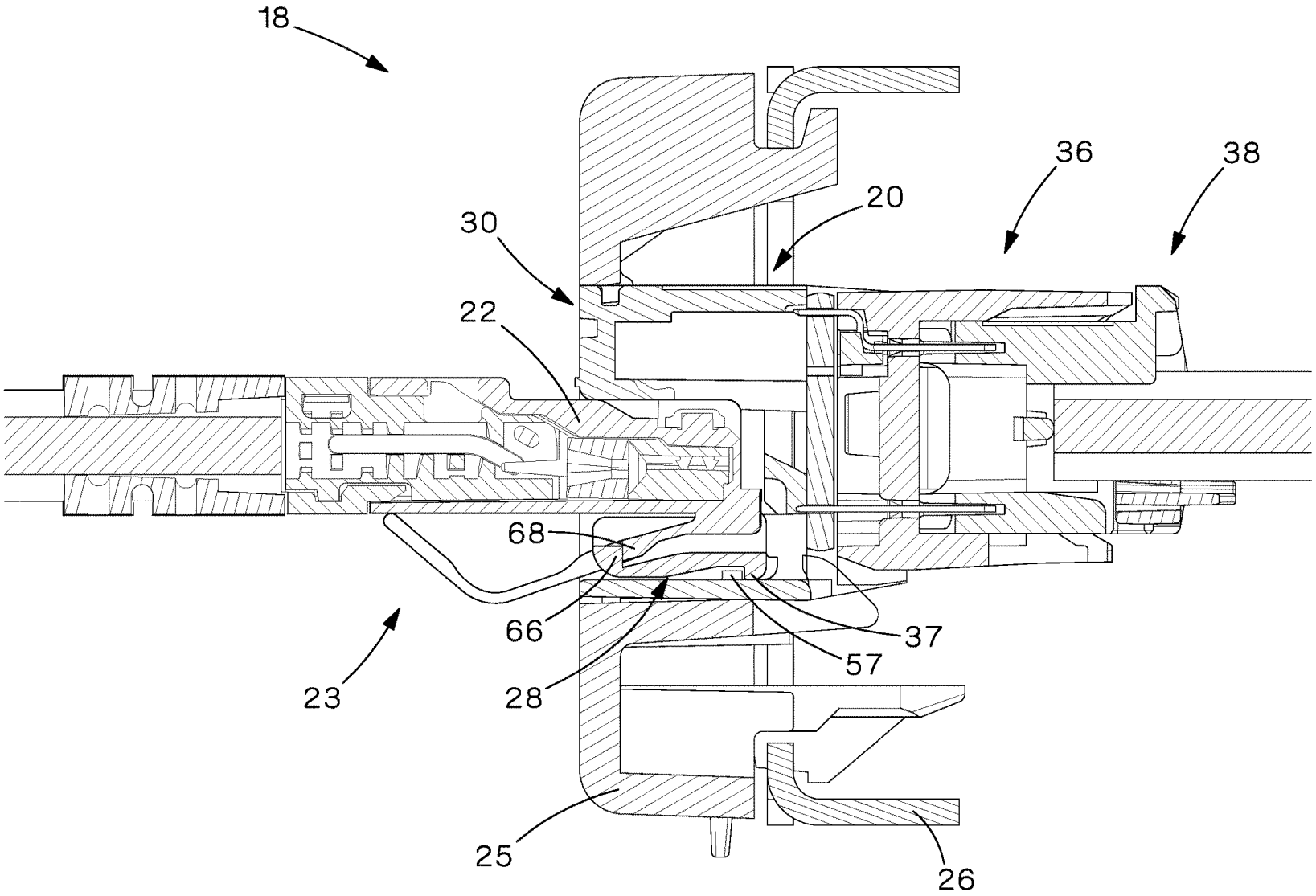
FIG. 7 is a cross-sectional view taken along line 7-7 of FIG. 1.

Referring to FIG. 7, plug latch stop 66 on shutter door 28 engages with latches 68 on plug 22, which secures plug 22 to UTP RJ45 shuttered jack 20 during assembly. When plug 22 is fully inserted into UTP RJ45 shuttered jack 20, free contact plug stop 35 (FIG. 5) on shutter door 28 limits the over-travel of plug 22 inside shuttered jack housing 30, meeting the IEC 60603-7 requirement. Retention ledge 37 on shutter door 28 captures retention block 57 of shuttered jack housing 30 when plug 22 is inserted. If plug 22 were to be subjected to a force in the direction of removal while latched to UTP RJ45 shuttered jack 20, retention ledge 37 on shutter door 28 would engage retention block 57 of shuttered jack housing 30, providing additional retention force and removing some of the force seen on slotted boss 48 and solid boss 51 of shuttered jack housing 30. By transferring a significant amount of this pulling force to retention block 57 and away from slotted boss 48 and solid boss 51. UTP RJ45 shuttered jack 20 is more effective at retaining patch cord 23 under tensile loads as well as meeting the IEC 60603-7 AP2.2 requirement.

Figure 8:
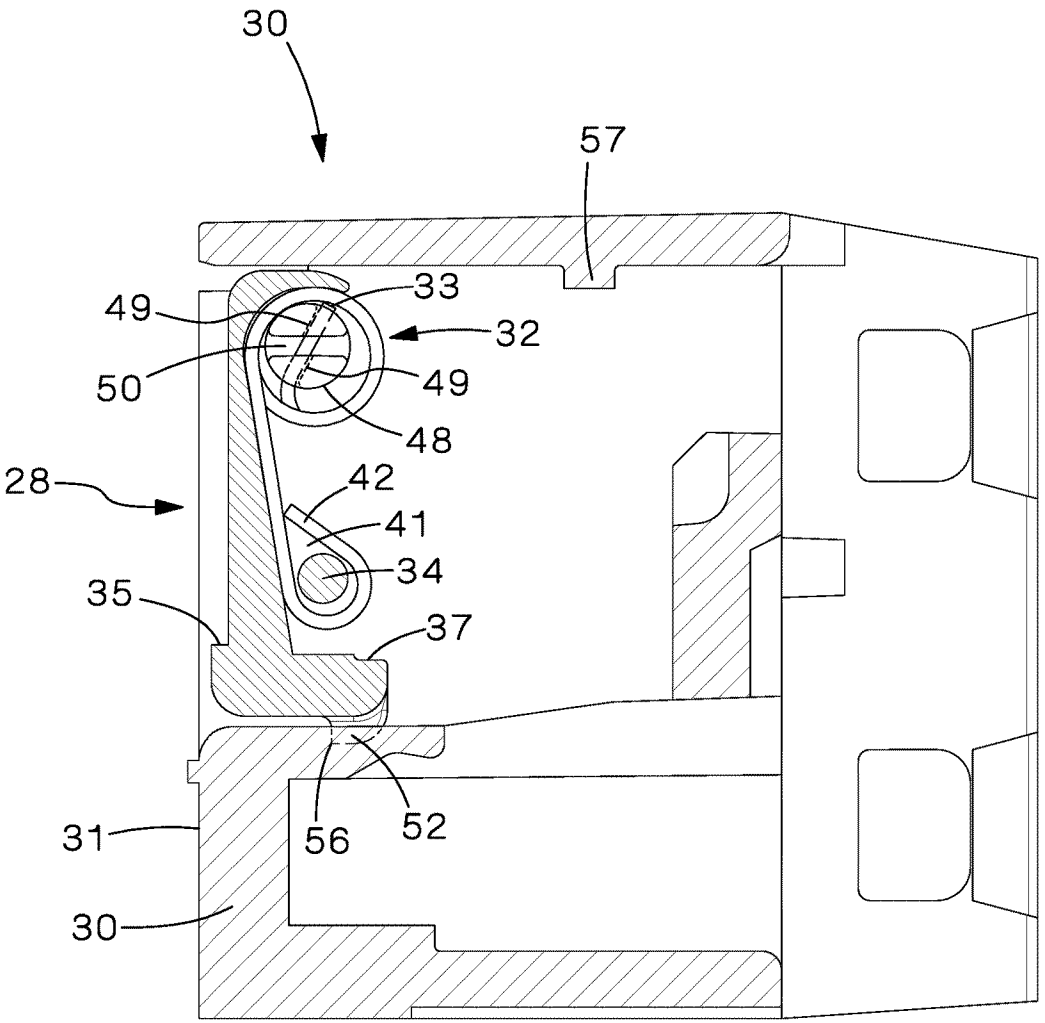
FIG. 8 is a cross-sectional view taken along line 8-8 of FIG. 2.
Figure 9:
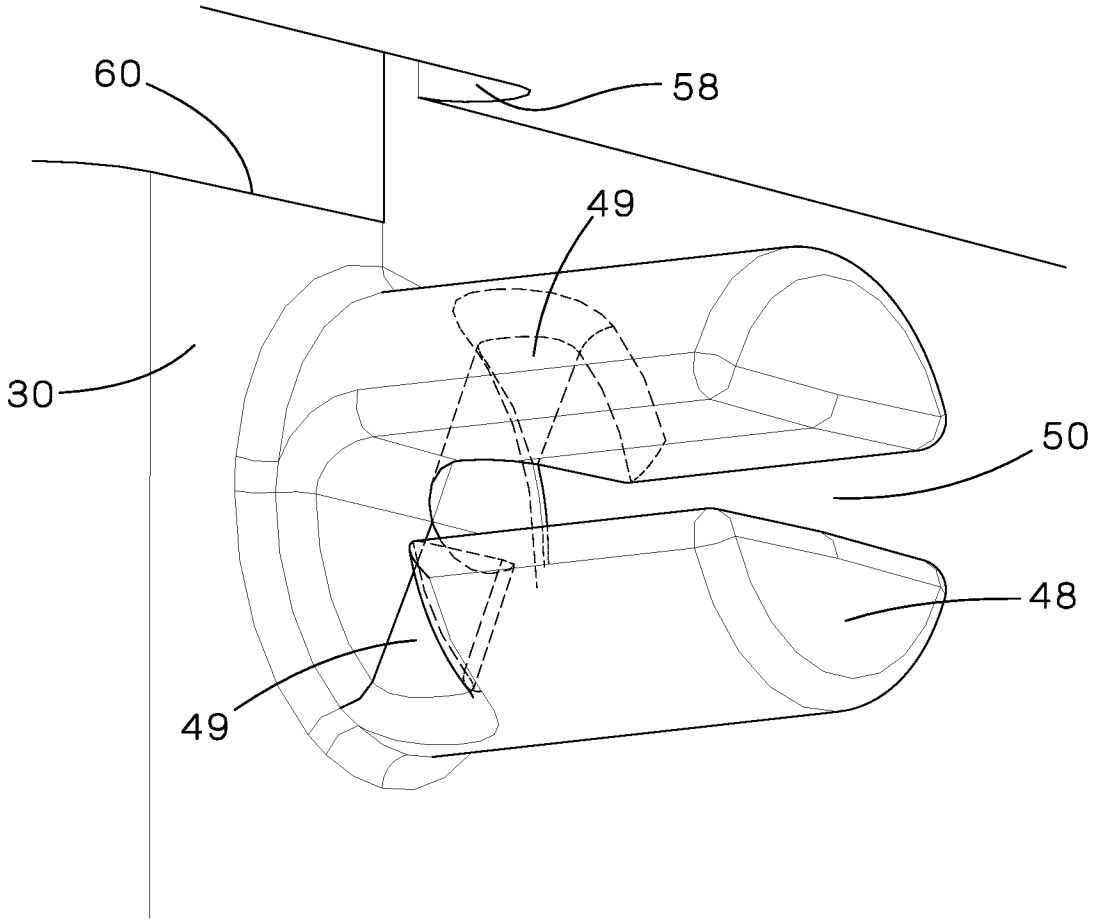
FIG. 9 is a detailed view of a slotted boss from the jack housing of FIG. 4.

Referring to FIGS. 8 and 9, as shutter door 28 is installed into shuttered jack housing 30, diagonal cross leg 33 of spring 32 engages in diagonal slot feature 49 of slotted boss 48.

Figure 10:
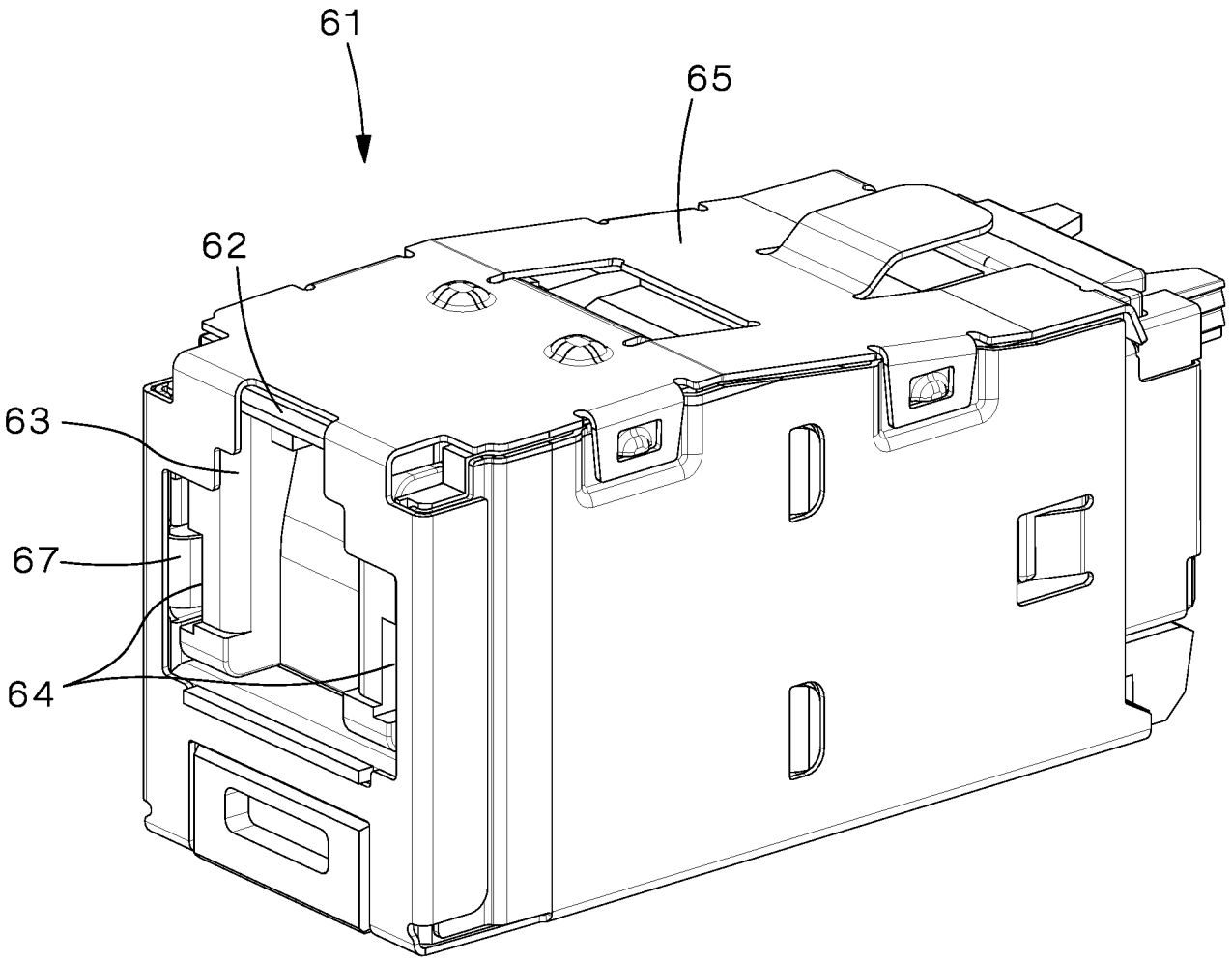
FIG. 10 is a perspective view of a jack according to an alternative embodiment of the present invention.
Figure 11:
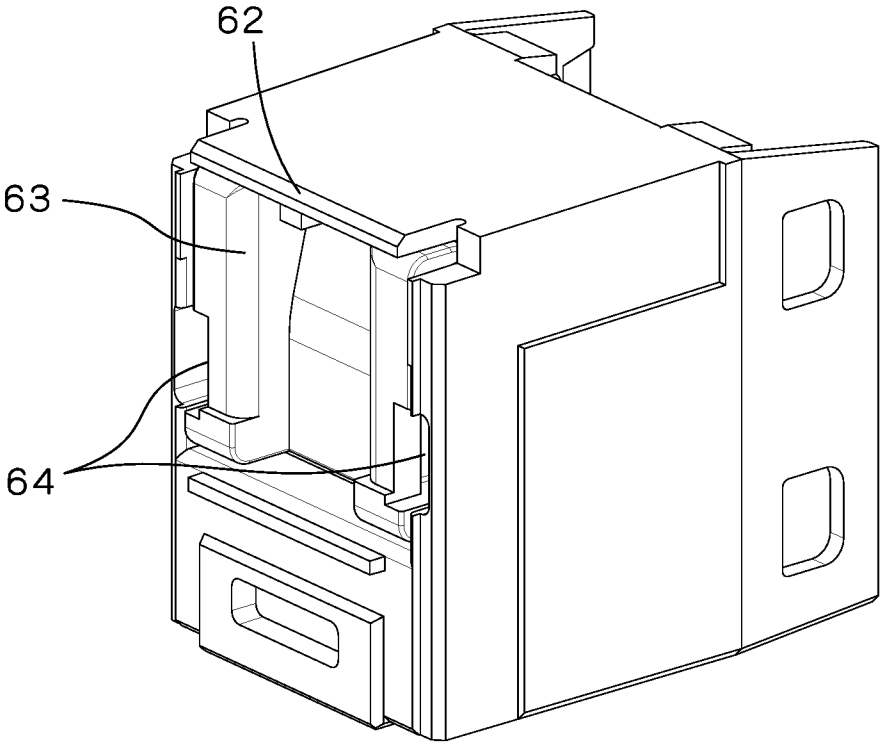
FIG. 11 is a perspective view of a jack housing from the jack of FIG. 10.

Referring to FIGS. 10 and 11, STP RJ45 shuttered jack 61, shown in a quiescent state, is similar to UTP RJ45 shuttered jack 20 (FIG. 2), except that STP RJ45 shuttered jack 61 includes shielded shuttered jack housing 62, shielded shutter door 63, and jack shield 65. Shielded shuttered jack housing

62 is similar to shuttered jack housing 30 (FIG. 4), except that shielded shuttered jack housing 62 accommodates jack shield 65. Shielded shutter door 63 is similar to shutter door 28 (FIG. 5), except that shielded shutter door 63 includes side cutouts 64, which allow for clearance of plug shield tabs 67 on jack shield 65.

Certain embodiments of the present invention provide an RJ45 jack that has a self-closing shutter door and allows for RJ45 plug insertion in one linear motion, but which incorporates a free contact plug stop on the shutter door and a door catch feature that aids in the retention of the door in the housing when a plug is subjected to a pull out force while latched into the jack.

Certain embodiments of the present invention can be applied in any of CAT5E, CAT6, CAT6A, and other applications, including other jacks.

Certain embodiments of the present invention can include other elements of existing jacks, such as a jack subassembly having a front housing, a front sled assembly with or without a flexible circuit board, a rigid circuit board including compensation, and insulation displacement contacts connected to the rigid board and routed through the rear housing.

Certain embodiment of the present invention can include other elements of the jacks disclosed in U.S. Pat. No. 6,869,297, which is incorporated by reference in its entirety.

Certain embodiment of the present invention can include other elements of the jacks disclosed in U.S. Pat. No. 7,281,957, which is incorporated by reference in its entirety.

Certain embodiments of the present invention can be used in patch panels, faceplates, adapter inserts, surface mount boxes, and any other applications for which a regular TG jack may be utilized.

While this invention has been described in terms of several embodiments, these embodiments are non-limiting (regardless of whether they have been labeled as exemplary or not), and there are alterations, permutations, and equivalents, which fall within the scope of this invention. Additionally, the described embodiments should not be interpreted as mutually exclusive, and should instead be understood as potentially combinable if such combinations are permissive. Moreover, any methods described or claimed, or that may be claimed should not be limited to any specific sequence of steps, and instead should be understood to encompass any sequence if such a sequence is allowable. It should also be noted that there are many alternative ways of implementing the methods and apparatuses of the present invention. It is therefore intended that claims that may follow be interpreted as including all such alterations, permutations, and equivalents as fall within the true spirit and scope of the present invention.

We claim:

1. An RJ45 communications jack comprising:

a housing having revolute joint features and a retention block;

a rotatable shutter door with integral plug latch stops, revolute joint features, and a retention ledge;

wherein upon rotation of the shutter door about the revolute joint features the retention ledge engages the retention block at a point radially distal from the revolute joint features so that when loads are applied to the plug latch stops, at least a portion of these loads are transferred to the housing via the retention block and not the revolute joint features.

2. The RJ45 communications jack of claim 1 wherein the housing further comprises relief slots 58.

3. The RJ45 communications jack of claim 2 wherein the rotatable shutter door further comprises a recessed plane.

* * * * *